US009459052B2

(12) United States Patent
Kinder et al.

(10) Patent No.: US 9,459,052 B2
(45) Date of Patent: Oct. 4, 2016

(54) COAXIAL GAS-LIQUID HEAT EXCHANGER WITH THERMAL EXPANSION CONNECTOR

(75) Inventors: Lee M. Kinder, Oakville (CA); Michael Bardeleben, Oakville (CA); Doug Vanderwees, Mississauga (CA); Brian E. Cheadle, Brampton (CA)

(73) Assignee: Dana Canada Corporation, Oakville, Ontario (CA)

( * ) Notice: Subject to any disclaimer, the term of this patent is extended or adjusted under 35 U.S.C. 154(b) by 515 days.

(21) Appl. No.: 13/407,975

(22) Filed: Feb. 29, 2012

(65) Prior Publication Data

US 2012/0222845 A1 Sep. 6, 2012

Related U.S. Application Data

(60) Provisional application No. 61/447,917, filed on Mar. 1, 2011.

(51) Int. Cl.

| | |
|---|---|
| ***F28D 7/10*** | (2006.01) |
| ***F28F 13/12*** | (2006.01) |
| *F28D 21/00* | (2006.01) |

(52) U.S. Cl.

CPC ..... *F28D 7/103* (2013.01); *F28F 13/12* (2013.01); *F28D 7/106* (2013.01); *F28D 21/0003* (2013.01); *F28D 2021/0082* (2013.01); *F28F 2265/26* (2013.01)

(58) Field of Classification Search

CPC ..... F28D 7/10; F28D 7/103; F28D 7/106; F28F 9/013; F28F 9/0241; F28F 2265/26

USPC ..... 165/81, 154, 141

See application file for complete search history.

(56) References Cited

U.S. PATENT DOCUMENTS

| | | | | |
|---|---|---|---|---|
| 1,335,506 | A * | 3/1920 | Jones | 165/161 |
| 1,639,051 | A * | 8/1927 | Munday | 165/141 |
| 2,135,235 | A * | 11/1938 | Hurford et al. | 165/135 |
| 2,238,952 | A | 4/1941 | Stacey | |
| 2,379,017 | A * | 6/1945 | McCollum | 126/116 R |
| 2,828,946 | A * | 4/1958 | Smith | 165/83 |
| 2,893,374 | A * | 7/1959 | Wilson, Sr. | 126/110 R |
| 3,170,511 | A | 2/1965 | Guthrie | |
| 3,226,135 | A * | 12/1965 | Epstein | 285/41 |
| 3,323,586 | A * | 6/1967 | Burne et al. | 165/154 |

(Continued)

FOREIGN PATENT DOCUMENTS

| | | |
|---|---|---|
| DE | 8807095 U | 7/1988 |
| GB | 620674 A | 3/1949 |

*Primary Examiner* — M. Alexandra Elve
*Assistant Examiner* — Eric Ruppert
(74) *Attorney, Agent, or Firm* — Marshall & Melhorn, LLC

(57) ABSTRACT

A co-axial gas-liquid heat exchanger such as a charge air cooler comprises at least three concentric tubes forming at least two annular flow passageways. One end of the inner tube is rigidly attached to the middle tube by a thermal expansion connector including an inner connecting portion secured to the first end of the inner tube, an outer connecting portion secured to an inner surface of the middle tube; and one or more webs connecting the inner connecting portion to the outer connecting portion. The webs extend across the annular gas flow passageway but permit the hot gas to flow therethrough. The other end of the inner tube is free to expand in the longitudinal direction, relative to the middle and outer tubes. In some embodiments, the inner connecting portion forms part of a central plug portion which blocks an end of the inner tube.

18 Claims, 8 Drawing Sheets

(56) References Cited

U.S. PATENT DOCUMENTS

| | | | | |
|---|---|---|---|---|
| 3,439,666 | A * | 4/1969 | Schuch | 126/110 R |
| 3,474,513 | A | 10/1969 | Allingham | |
| 3,493,041 | A | 2/1970 | Hourwitz et al. | |
| 3,831,247 | A * | 8/1974 | Degroote | 29/890.036 |
| 3,913,663 | A | 10/1975 | Gates | |
| 4,059,882 | A | 11/1977 | Wunder | |
| 4,392,526 | A | 7/1983 | Hage et al. | |
| 4,993,479 | A | 2/1991 | Jekerle | |
| RE35,890 | E | 9/1998 | So | |
| 6,273,183 | B1 | 8/2001 | So et al. | |
| 6,460,520 | B1 * | 10/2002 | Challis | 123/568.12 |
| 7,191,824 | B2 | 3/2007 | Wu et al. | |
| 7,225,859 | B2 * | 6/2007 | Mochizuki et al. | 165/10 |
| 2005/0045315 | A1 | 3/2005 | Seager et al. | |
| 2009/0193804 | A1 * | 8/2009 | Ohno et al. | 60/516 |
| 2009/0260586 | A1 | 10/2009 | Geskes et al. | |

* cited by examiner 52
22
12
10
24
14

24
12
22

22
10
30

24
14

COAXIAL GAS-LIQUID HEAT EXCHANGER WITH THERMAL EXPANSION CONNECTOR

CROSS-REFERENCE TO RELATED APPLICATION

This application claims priority to and the benefit of U.S. Provisional Patent Application No. 61/447,917 filed Mar. 1, 2011, the contents of which are incorporated herein by reference.

FIELD OF THE INVENTION

The invention generally relates to heat exchangers for cooling a hot gas with a liquid coolant, and particularly to gas-liquid heat exchangers having a coaxial or concentric tube construction, for gas cooling in vehicle engine systems.

BACKGROUND OF THE INVENTION

Gas-liquid heat exchangers have numerous applications. For example, in vehicles, gas-liquid heat exchangers can be used to cool compressed charge air in turbocharged internal combustion engines or in fuel cell engines. Gas-liquid heat exchangers can also be used to cool hot engine exhaust gases.

Various constructions of gas-liquid heat exchangers are known. For example, it is known to construct gas-liquid heat exchangers comprised of two or more concentric tubes, with the annular spaces between adjacent tubes serving as fluid flow passages. Corrugated fins are typically provided in the flow passages to enhance heat transfer and, in some cases, to join together the tube layers.

Coaxial or concentric tube gas-liquid heat exchangers have the advantage that they are relatively compact and inexpensive, making them suitable for use in vehicles. However, durability of concentric tube heat exchangers can be a concern. For example, thermal stresses resulting from differential thermal expansion of the various tube layers can lead to premature failure of concentric tube heat exchangers. The differential thermal expansion is due to the fact that one or more of the tubes will be in contact with the relatively hot gases, whereas at least one of the tubes will be in contact with the relatively cool liquid. The problem of differential thermal expansion has been partly addressed in the prior art by leaving the fins unbonded to one or both of the tubes with which they are in contact, for example as disclosed in U.S. Pat. No. 3,474,513 to Allingham. This permits relative longitudinal expansion of the tube layers while avoiding excessive thermal stresses. However, leaving the fins unbonded can reduce heat transfer from the fins to the tubes, and may permit longitudinal slippage or displacement of the tubes relative to one another.

Therefore, there remains a need for coaxial or concentric tube heat exchangers which are effective and efficient in terms of operation, use of space and durability.

SUMMARY OF THE INVENTION

According to an embodiment, there is provided a concentric tube heat exchanger, comprising: an outer tube having a first end and a second end; an inner tube concentric with the outer tube, the inner tube having a first end and a second end; and a middle tube located between, and concentric with, the inner and outer tubes, wherein the middle tube has a first end and a second end, wherein an annular gas flow passage is formed between the inner tube and the middle tube, and wherein an annular coolant flow passage is formed between the middle tube and the outer tube. The heat exchanger further comprises a thermal expansion connector comprising an inner connecting portion rigidly connected to the first end of the inner tube; an outer connecting portion rigidly connected to an inner surface of the middle tube; and one or more webs extending between the inner connecting portion and the outer connecting portion, wherein each of the one or more webs has an inner end rigidly connected to the inner connecting portion and an outer end rigidly connected to the outer connecting portion, and wherein the one or more webs permit gas to flow into the annular gas flow passage. The heat exchanger further comprises a turbulence-enhancing insert provided in the gas flow passageway, wherein the insert is in contact with the outer surface of the inner tube and the inner surface of the middle tube.

In an embodiment, the one or more webs have a combined area which is a minor amount of the total area of the gas flow passage, in a plane which is transverse to the longitudinal axis of the tubes.

In an embodiment, the thermal expansion connector includes at least two of said webs, and wherein said webs are spaced evenly about the circumference of the inner tube. For example, the thermal expansion connector may comprise three of said webs, wherein said webs are spaced evenly about the inner tube.

In an embodiment, at least the first end of the inner tube is blocked.

In an embodiment, the thermal expansion connector further comprises a blocking portion which blocks the first end of the inner tube, wherein the inner connecting portion and the blocking portion together form a central plug portion which is rigidly connected to the first end of the inner tube.

In an embodiment, the inner connecting portion and the blocking portion are integrally formed. For example, the central plug portion may be in the shape of a cup with the inner connecting portion forming a cylindrical side wall of the cup and the blocking portion forming a bottom of the cup, wherein the blocking portion is located inwardly of the first end of the inner tube. The cup may further comprise a circumferential lip which is distal from the blocking portion and protrudes beyond the end of the inner tube, wherein the inner ends of the webs are connected to the circumferential lip.

In an embodiment, the inner connecting portion of the thermal expansion connector comprises a longitudinally extending cylindrical ring, and the inner ends of the one or more webs are rigidly connected to the inner connecting portion. The inner connecting portion may have an outside diameter slightly less than an inside diameter of the first end of the inner tube, wherein the inner connecting portion has an outer surface along which it is rigidly connected to an inner surface of the first end of the inner tube. Alternatively, the inner connecting portion may have an inside diameter slightly greater than an outside diameter of the first end of the inner tube, wherein the inner connecting portion has an inner surface along which it is rigidly connected to an outer surface of the first end of the inner tube.

In an embodiment, the outer connecting portion of the thermal expansion connector comprises a longitudinally extending cylindrical ring, and wherein the outer ends of the one or more webs are rigidly connected to the outer connecting portion.

In an embodiment, the thermal expansion connector includes a plurality of said webs and a plurality of said outer connecting portions, wherein the outer end of each said web is rigidly connected to one of said outer connecting portions.

In an embodiment, the thermal expansion connector includes a plurality of said webs and a plurality of said inner connecting portions, wherein the inner end of each said web is rigidly connected to one of said inner connecting portions.

In an embodiment, each end of the middle tube is adapted for connection to a gas flow conduit, wherein the first end of the inner tube is located inside the middle tube. The inner tube may be shorter than the middle tube, wherein both the first and second ends of the inner tube are located inside the middle tube.

In an embodiment, the outer tube is shorter than the middle tube, wherein the outer tube is sealed at its first and second ends to the outer surface of the middle tube.

In an embodiment, the outer tube is provided with inlet and outlet openings for a liquid coolant.

In an embodiment, the annular coolant flow passage is provided with a turbulence enhancing insert which is in contact with the outer surface of the middle tube and the inner surface of the outer tube. The turbulence enhancing insert in the annular coolant flow passage may be a turbulizer, wherein the turbulizer is joined to the outer surface of the middle tube by brazing, and is not brazed to the inner surface of the outer tube.

In an embodiment, the turbulence enhancing insert in the annular gas flow passage is a corrugated fin, wherein the fin is joined to the inner surface of the middle tube by brazing, and is not brazed to the outer surface of the inner tube.

According to another embodiment, a hot gas cooling system comprises a first concentric tube heat exchanger according to the invention, and a second concentric tube heat exchanger according to the invention, wherein the middle tube of the first concentric tube heat exchanger is connected to the middle tube of the second concentric tube heat exchanger so as to provide flow communication between the annular gas flow passage of the first heat exchanger and the annular gas flow passage of the second heat exchanger.

According to an embodiment, an outlet of the annular coolant flow passage of the first concentric tube heat exchanger is in flow communication with the inlet of the annular coolant flow passage of the first concentric tube heat exchanger through a coolant conduit. The heat exchanger for removing heat from said coolant may be located in said coolant conduit between the first and second concentric tube heat exchangers.

BRIEF DESCRIPTION OF DRAWINGS

The invention will now be described, by way of example only, with reference to the accompanying drawings, in which.

DETAILED DESCRIPTION

Figure 1:
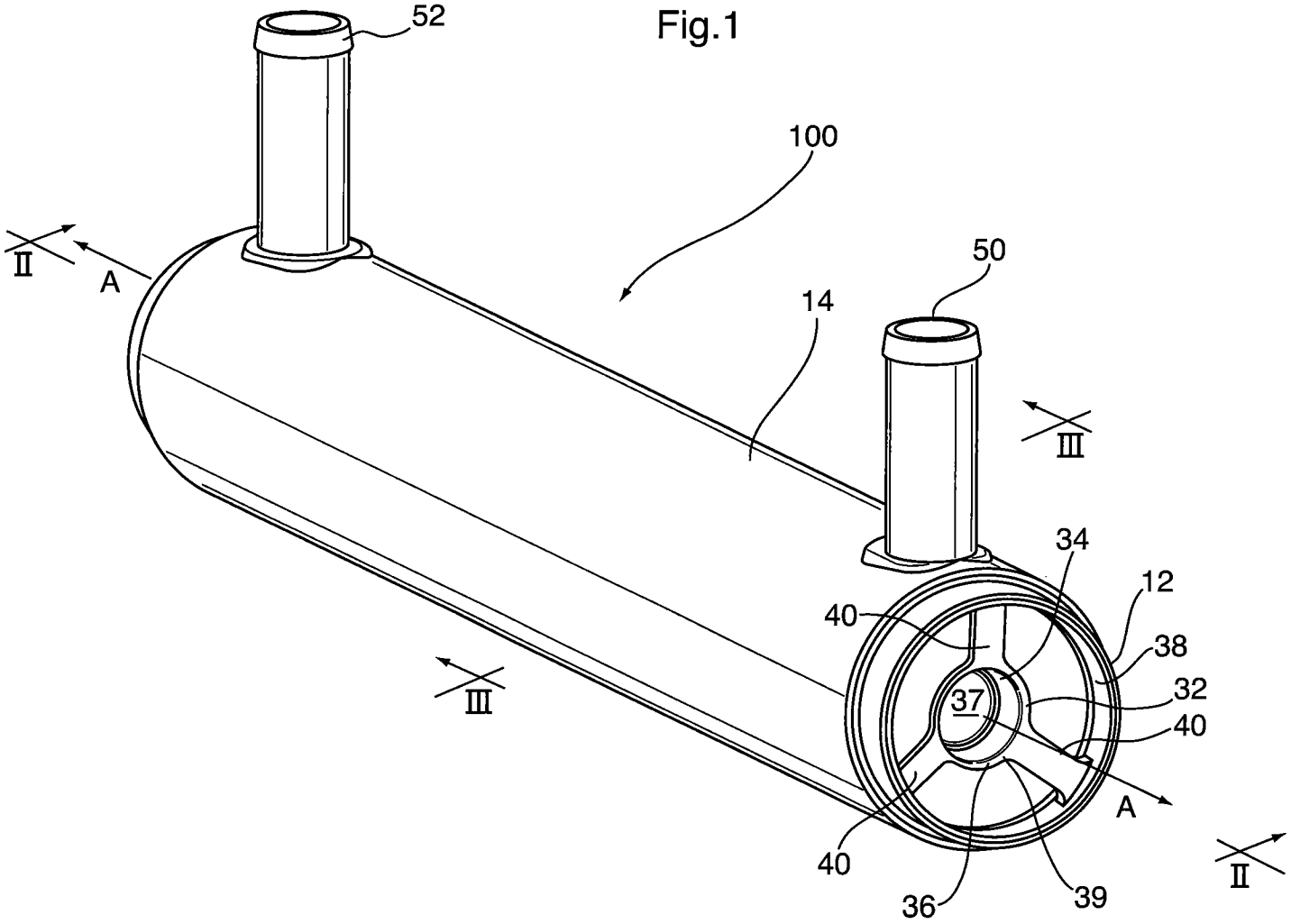
FIG. 1 is a perspective view of a gas-liquid heat exchanger according to an embodiment of the invention.

The following is a description of the embodiments of the invention illustrated in the drawings.

In the following description, the embodiments of the invention will be described as charge air coolers for use in a turbocharged vehicle engine system. In a turbocharged internal combustion engine, intake air for combustion is pressurized by a compressor before entering the intake manifold of the engine. Compression of the air causes its temperature to increase. A charge air cooler may be positioned between the outlet of the air compressor and the inlet of the intake manifold to remove excess heat from the compressed air. It will, however, be appreciated that the heat exchangers according to the invention may be used for cooling other hot gases in a vehicle engine system, such as exhaust gases.

As used herein, the terms “inner” and “outer” are used as terms of reference to describe the relative radial locations of certain elements of heat exchangers with respect to a central longitudinal axis.

The gas-liquid heat exchangers according to the invention are co-axial or concentric, and are constructed from at least three concentric tubes. The terms “coaxial” and “concentric” are used interchangeably herein to describe the orientation of the tubes of the heat exchanger. The flow of coolant and the flow of hot gas through the heat exchanger are therefore parallel to the longitudinal axes of the tubes. The fluid flow through the heat exchanger may either be “co-flow”, in which case the hot gas and coolant flow in the same direction, or “counter-flow”, in which case the hot gas and coolant flow in opposite directions. Although the embodiments described below are counter-flow heat exchangers, it will be appreciated that they may be converted to co-flow heat exchangers by changing the direction of flow of either the hot gas or the liquid coolant.

The components of the heat exchangers according to the invention may be formed from tubes and/or sheets of metal, such as aluminum or an aluminum alloy, and may be assembled by one or more brazing operations. Filler metal for brazing may be in the form of cladding layers provided on at least some of the components of the heat exchangers, and/or by applying brazing alloy to one or more components prior to brazing, the brazing alloy being in the form of a shim or other perform, or in the form of a paste. It will be appreciated that other materials may be used to construct the heat exchangers according to the invention, and that the use of alternate materials may necessitate alternate joining methods. In the following description, it is generally assumed that the heat exchangers are constructed from aluminum or aluminum alloy components which are joined together by brazing.

A heat exchanger 100 comprised of three concentrically arranged tubes is now described with reference to FIGS. 1 to 9. The three tubes making up heat exchanger 100 are: an inner tube 10, a middle tube 12 and an outer tube 14. The inner tube 10 is located within the middle tube 12. The middle tube 12 is located within the outer tube 14, and forms part of a continuous charge air passage leading from the outlet of the air compressor (not shown) to the inlet of the intake manifold (not shown). All three tubes 10, 12, 14 share a common longitudinal, central axis, labelled "A" in the drawings. The ends of the middle tube 12 may extend past the ends of the inner and outer tubes 10, 14 and may be provided with fittings or other connection means (not shown) by which the ends of middle tube 12 are connected to conduits (not shown) which lead to the compressor and the intake manifold, respectively, thereby forming a continuous charge air passage.

It will be appreciated, however, that various alternate arrangements may be used for connecting heat exchangers according to the invention to other system components. For example, it is possible that the ends of the outer tube 14 may be provided with fittings or other connection means by which the heat exchanger 100 is connected to conduits leading to the compressor and intake manifold. In this alternate arrangement, the ends of the outer tube 14 may extend beyond the ends of both the middle tube 12 and the inner tube 10.

Within heat exchanger 100, two annular passageways are formed by the coaxial, concentric arrangement of the three tubes 10, 12, 14. An inner annular passageway 18 is formed between the outer surface of inner tube 10 and the inner surface of middle tube 12. An outer annular passageway 20 is formed between the outer surface of middle tube 12 and the inner surface of outer tube 14. Each annular passageway 18, 20 is provided with a turbulence-enhancing insert such as a corrugated fin or a turbulizer in order to provide increased turbulence and surface area for heat transfer, and to provide structural support for the inner and middle tubes 10, 12. The corrugated fins and turbulizers are only schematically shown in the drawings, with fins being identified by reference numeral 22 and the turbulizers being identified by reference numeral 24.

As used herein, the terms "fin" and "turbulizer" are intended to refer to corrugated turbulence-enhancing inserts having a plurality of axially-extending ridges or crests connected by side walls, with the ridges being rounded or flat. As defined herein, a "fin" has continuous ridges whereas a "turbulizer" has ridges which are interrupted along their length, so that axial flow through the turbulizer is tortuous. Turbulizers are sometimes referred to as offset or lanced strip fins, and example of such turbulizers are described in U.S. Pat. No. Re. 35,890 (So) and U.S. Pat. No. 6,273,183 (So et al.). The patents to So and So et al. are incorporated herein by reference in their entireties.

Figures 6, 7, 8, 9:
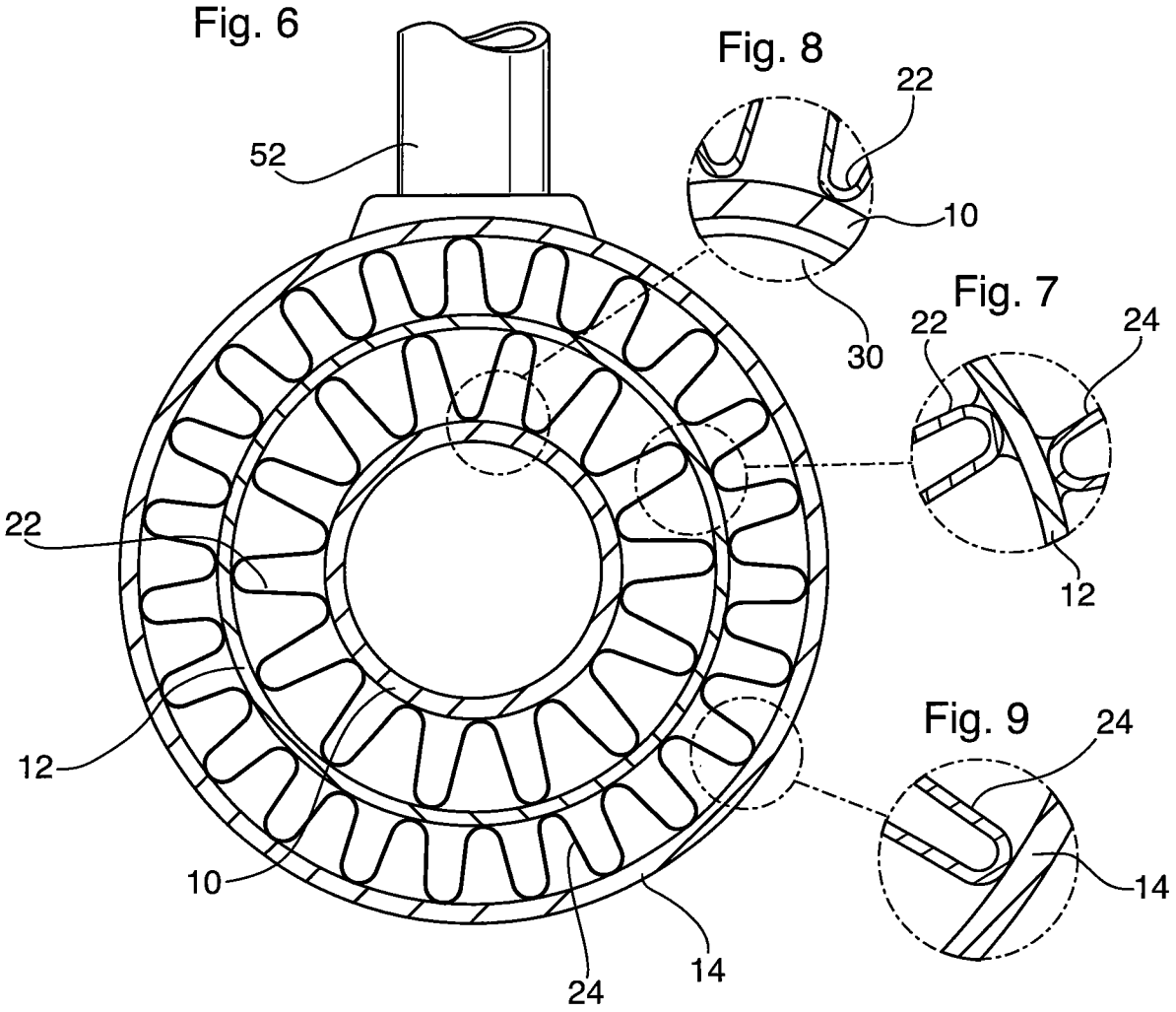
FIG. 6 is a transverse cross section along line of FIG. 1.
FIG. 7 is a close-up of area A of FIG. 6.
FIG. 8 is a close-up of area B of FIG. 6.
FIG. 9 is a close-up of area C of FIG. 6.

Each of the annular passageways 18, 20 may be provided with either a corrugated fin 22 or a turbulizer 24. The openings between adjacent ridges of the fin 22 or turbulizer are oriented along axis A as shown in FIG. 6 so as to permit longitudinal flow through passageways 18, 20.

In heat exchanger 100, a corrugated cooling fin 22 is positioned in the inner air passageway 18 and a turbulizer 24 is positioned in the outer coolant passageway 20. As shown in the transverse cross section of FIG. 6, the top and bottom surfaces of fin 22 and of turbulizer 24 are in contact with the surfaces of the tubes between which they are positioned. The words "top" and "bottom" are used herein as terms of reference to indicate relative radial distance from central axis A, with the top being spaced from axis A by a greater distance than the bottom.

In particular, the top and bottom surfaces of the corrugated fin 22 are in contact with the inner surface of middle tube 12 and the outer surface of inner tube 10, respectively, while the top and bottom surfaces of the turbulizer 24 are in contact with the inner surface of outer tube 14 and the outer surface of middle tube 12, respectively. Contact between the tubes 10, 12, 14 and the fin 22 or turbulizer 24 is important for structural support of the tubes and to maintain their concentric arrangement. Contact is also important for providing heat transfer between the fin 22 or turbulizer 24 and at least one of the surrounding tube surfaces. This is discussed in more detail below.

Figure 2:
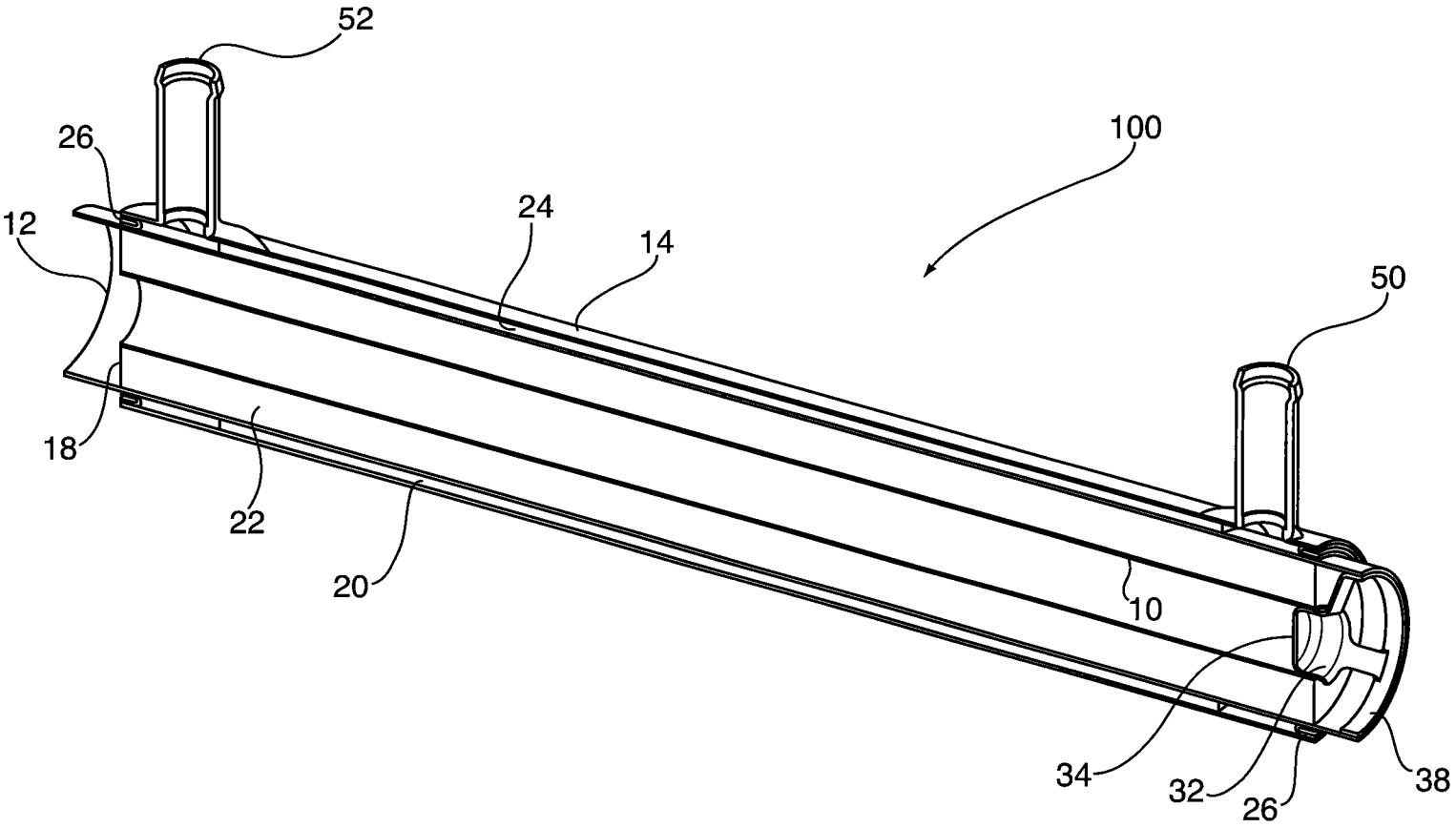
FIG. 2 is a longitudinal cross section along line II-II of FIG. 1.
Figure 3:
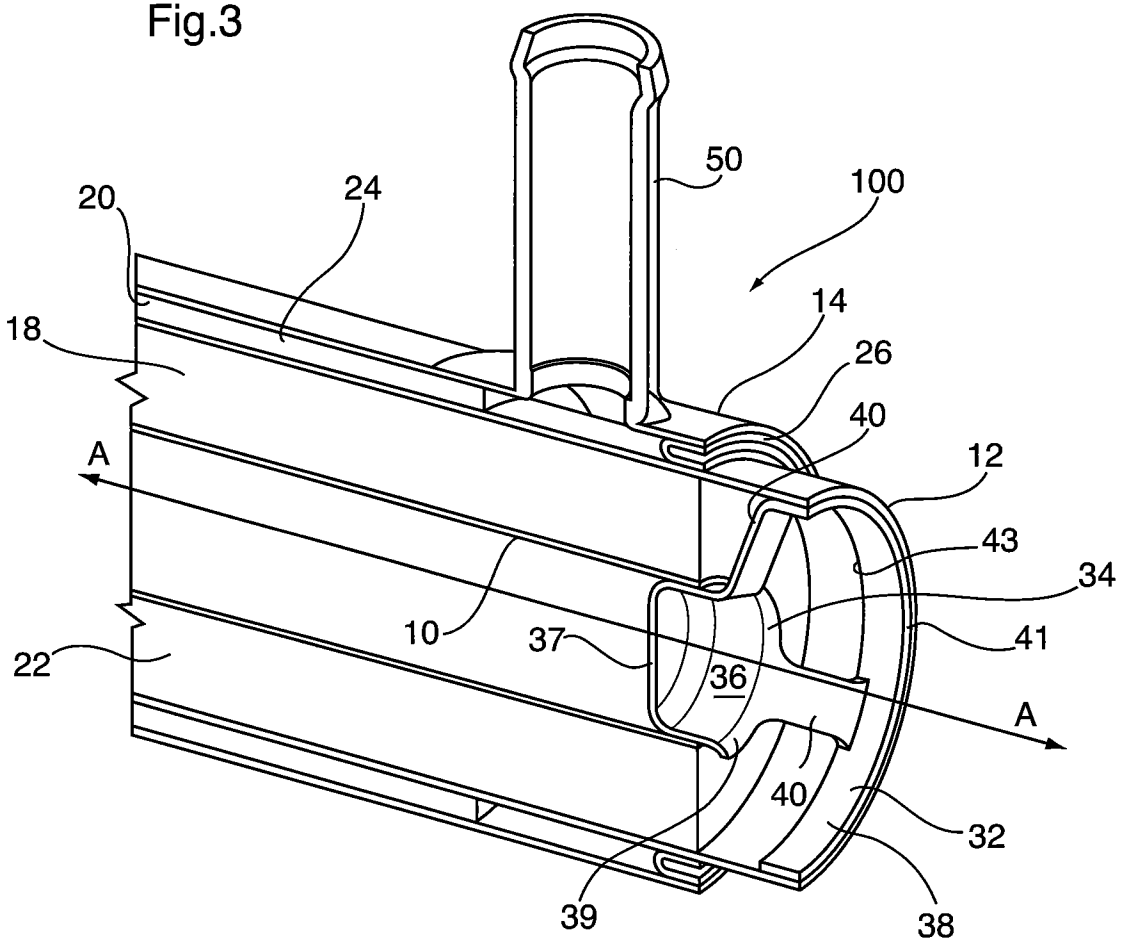
FIG. 3 is an enlargement of a portion of FIG. 2.
Figure 5:
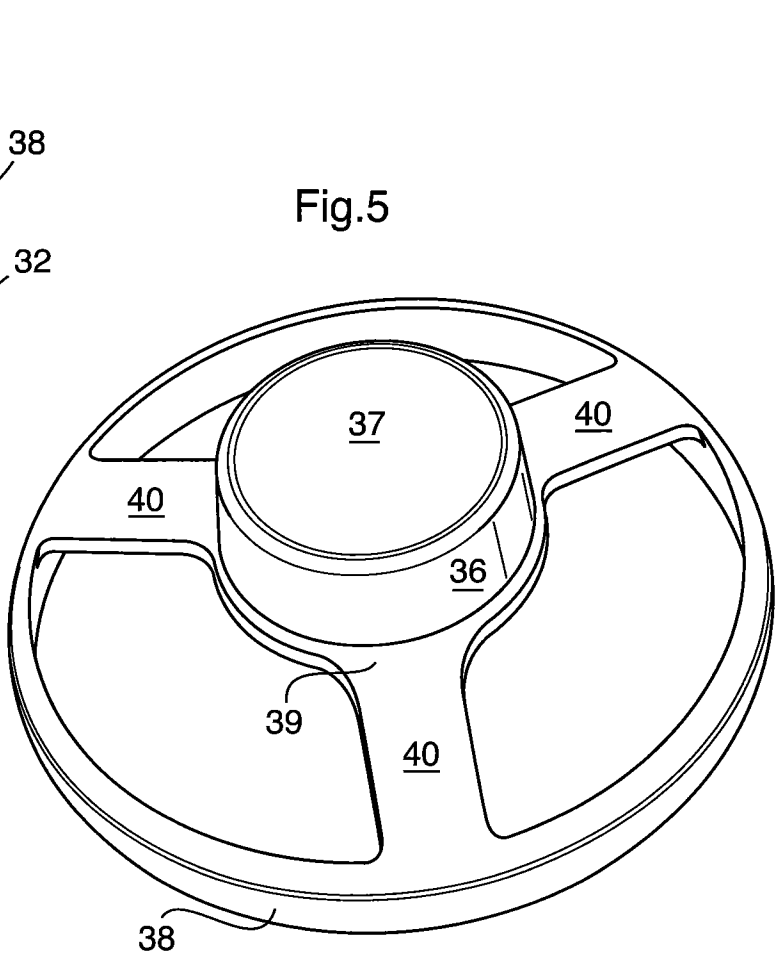
FIG. 5 is a rear perspective view of a thermal expansion connector of the heat exchanger of FIG. 1, shown in isolation.
Figure 4:
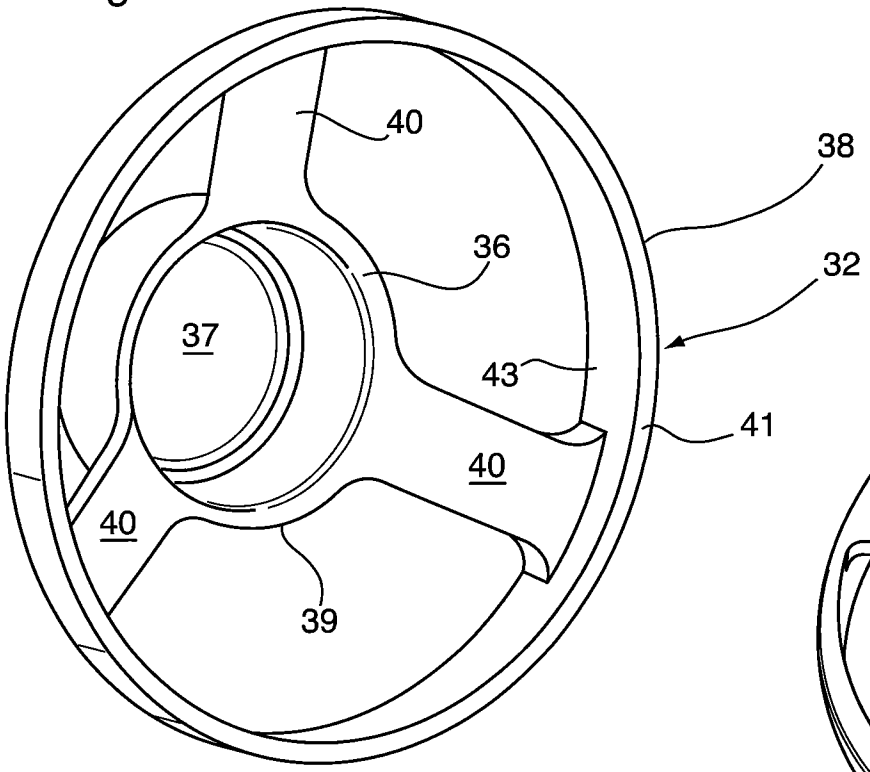
FIG. 4 is a front perspective view of a thermal expansion connector of the heat exchanger of FIG. 1, shown in isolation.

As best seen in FIGS. 2 and 3, the fin 22 in the inner air passageway 18 extends to the ends of inner tube 10, while the turbulizer 24 in the outer coolant passageway 20 stops short of the coolant inlet and outlet fittings (discussed below) in order to provide inlet and outlet manifold spaces for the coolant.

The two ends of the outer coolant passageway 20 are closed by annular end caps 26, and inlet and outlet fittings 50, 52 are provided for connection to conduits (not shown) which connect the outer coolant passageway 20 to other components in the cooling system, which may or may not include other heat-generating components of the vehicle. The end caps 26 may be brazed between the middle and outer tubes 12, 14 so as to seal the ends of the coolant passageway 20, and also to provide a rigid connection between the middle tube 12 and the outer tube 14. Instead of end caps 26, the ends of the coolant passageway 20 may be shaped so as to bring them into contact with the middle tube 12. This may be accomplished by deformation of the ends of outer tube 14, and/or by expansion of the middle tube 12, such that a lap joint is formed between the inner surface of the outer tube 14 and the outer surface of the middle tube 12, the lap joint being brazed. Also, although the end caps 26 are shown as having a U-shaped cross section, it will be appreciated that this is not necessarily the case. Rather, the end caps 26 may comprise simple annular rings of square or rectangular cross section.

The inner tube 10 is "blind" or "dead", meaning that charge air is prevented from flowing through the inner tube 10, and all of the charge air is directed into the annular passageway 18 where it transfers heat to the liquid coolant through the wall of middle tube 12. Therefore, at least one end of inner tube 10 is closed or blocked to prevent air flow therethrough. In heat exchanger 100, one end of inner tube 10 is closed by a thermal expansion connector, which is described below in more detail. The other end of inner tube 10 is either left open, as shown in the drawings, or may be closed by a simple end plug (not shown).

In the heat exchanger 100 shown in FIGS. 1 to 9, the thermal expansion connector 32 has a central plug portion 34 which blocks and seals the end of the inner tube 10. In this embodiment of the invention, the central plug portion 34 is cup-shaped and fits snugly inside the end of inner tube 10. The central plug portion 34 comprises two integrally formed elements, an inner connecting portion 36 and a blocking portion 37. When installed inside the end of inner tube 10, the inner connecting portion 36 is oriented longitudinally and sealingly contacts the inner surface of inner tube 10, while the blocking portion 37 is arranged transversely and blocks the end of inner tube 10. In the embodiment shown in the drawings, the central plug portion 34 has a cup shape with the inner connecting portion 36 forming a cylindrical side wall of the cup and the blocking portion 37 forming a flat bottom of the cup, but this is not necessary. For example, the central plug portion 34 may be made shallower or deeper by adjusting the thickness of the blocking portion 37 and/or the height of inner connecting portion 36 (both measured along axis A), such that the inner connecting portion 36 simply comprises the outer surface of the blocking portion 37. Also, the blocking portion 37 is not necessarily flat, but may instead have a concave, convex or other suitable shape.

In heat exchanger 100, the inner connecting portion 36 of expansion connector 32 is in the form of a cylindrical ring which extends continuously around the entire circumference of the blocking portion 37 and has an outside diameter slightly less than the inner diameter of inner tube 10, such that it fits snugly within the end of inner tube 10, with the blocking portion 37 spaced inwardly from the end of the inner tube 10. The inner connecting portion 36 has an outer surface along which the expansion connector 32 is joined to an end of the inner tube 10, for example by brazing, thereby forming a rigid sealed connection between the thermal expansion connector 32 and one end of the inner tube 10.

The inner connecting portion 36 has a circumferential lip 39 which is distal from the blocking portion 37 and which may protrude somewhat beyond the end of the inner tube 10. As shown in the drawings, the lip 39 may be flared outwardly relative to the inner connecting portion 36 so as to provide a stop which ensures proper positioning of the central plug portion 34 within the end of inner tube 10.

The thermal expansion connector 32 also has at least one outer connecting portion 38 having an outer surface which is rigidly connected to the inner surface of the middle tube 12. When installed inside the middle tube 12, the outer connecting portion 38 is oriented longitudinally and has an outside diameter slightly less than the inner diameter of middle tube 12, such that it fits snugly within the middle tube 12. The outer surface of outer connecting portion 38 provides a surface along which the expansion connector 32 is joined to the middle tube 12, for example by brazing. The outer connecting portion 38 has a first end 41 which is proximal to the end of middle tube 12, and a second end 43 which is longitudinally spaced from the first end, and is distal to the end of the middle tube 12. In the heat exchanger 100, the first end 41 of outer connecting portion 38 is located slightly inside the end of middle tube 12, but it will be appreciated that this arrangement is not necessary. Rather, the outer connecting portion 38 may protrude from the end of middle tube 12 or be inserted farther into the end of the middle tube 12.

The thermal expansion connector 32 further comprises a plurality of webs 40 extending between the outer connecting portion 38 and the central plug portion 34. In the illustrated embodiment, the webs 40 extend between the second end 43 of the outer connecting portion 38 and the lip 39 of the central plug portion 34. Because the inner connecting portion 36 and outer connecting portion 38 are rigidly connected to the inner tube 10 and middle tube 12, respectively, the webs 40 therefore provide a rigid connection between the middle tube 12 and one end of the inner tube 10. The webs 40 are of sufficient number and thickness so as to maintain a rigid connection between tubes 10, 12, without significantly impairing air flow through the inner passageway 18. For example, the combined area of the webs 40, in a plane which is transverse to longitudinal axis A, may be a minor amount of the total transverse area of the inner annular passageway 18, the term "a minor amount" meaning less than 50 percent. At least two webs 40 may be provided, and three webs 40 are provided in heat exchanger 100. It will be appreciated that more or fewer webs 40 may be provided than are shown in the illustrated embodiment. The webs 40 may be evenly spaced about the circumference of the inner connecting portion 36.

As best seen in FIG. 3, the webs 40 extend radially between the middle tube 12 and inner tube 10. The webs 40 may also extend in the longitudinal direction due at least partially to the longitudinal spacing between the lip 39 of the central plug portion 34 and the second end 43 of the outer connecting portion 38, and also due to the positioning of the outer connecting portion 38 at the end of the middle tube 12. It will be appreciated that the webs 40 may be more transverse to the axis A, i.e. have less of a longitudinal slope, where the longitudinal spacing between lip 39 and second end 43 is reduced or eliminated, and/or where the outer connecting portion 38 is positioned farther inside the end of the middle tube 12.

Figure 13:
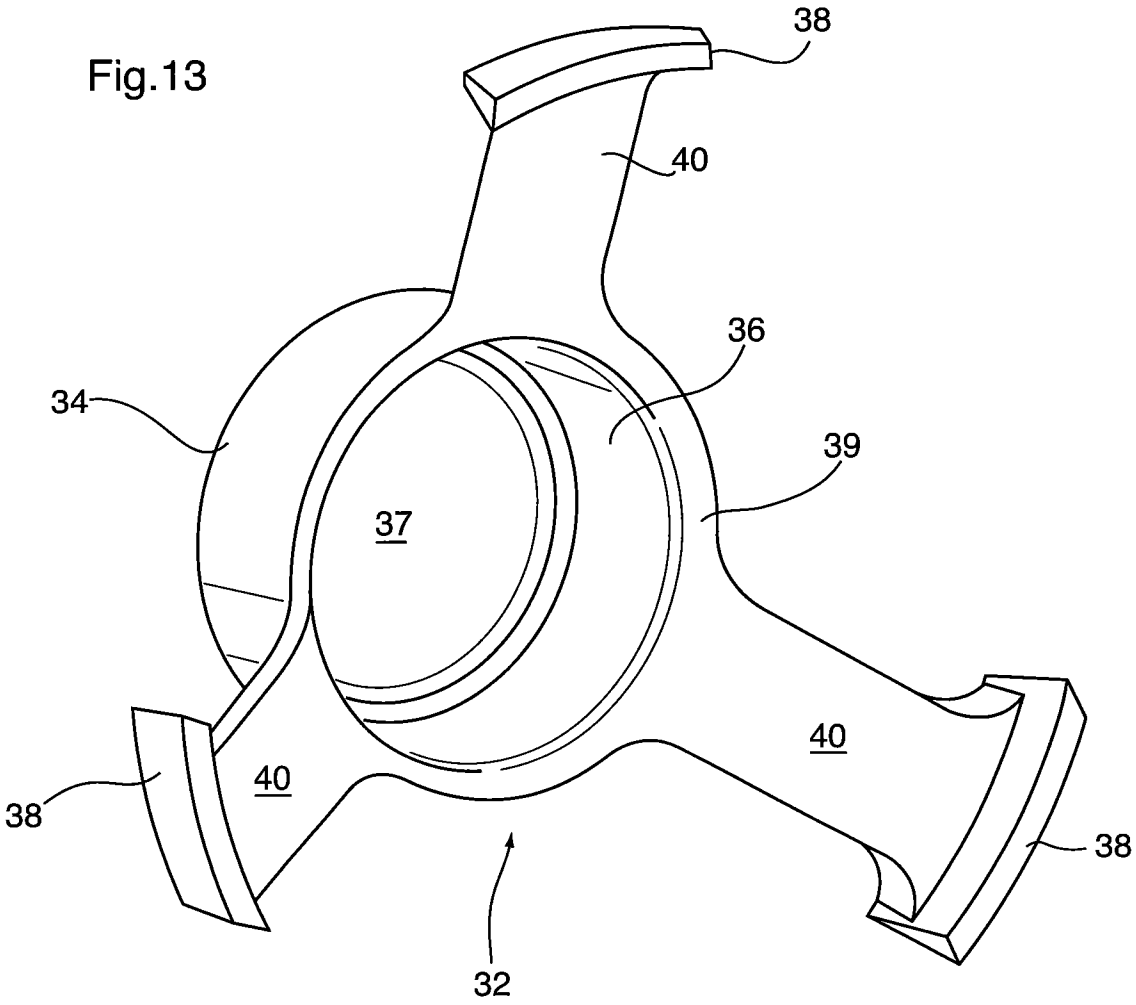
FIG. 13 is a front perspective view of a thermal expansion connector having a plurality of outer connecting portions.

Although the outer connecting portion 38 is shown as comprising a continuous cylindrical ring, it will be appreciated that this is not necessarily the case. Since the function of the outer connecting portion 38 is to connect the webs 40 to the middle tube 12, the outer connecting portion 38 does not need to be in the form of a continuous ring. Rather, the expansion connector 32 may be attached to middle tube 12 by two or more outer connecting portions 38 which are spaced apart from one another. For example, a plurality of outer connecting portions 38 may be provided, each comprising a discrete, longitudinal end portion of a web 40, through which the web 40 is attached to the middle tube 12. An example of a thermal expansion connector 32 having this configuration is illustrated in FIG. 13.

Furthermore, it will be appreciated that the webs 40 are not necessarily connected to the second end 43 of outer connecting portion 38, although this may be convenient where the entire expansion connector 32 is integrally formed from a single sheet of metal. It will be appreciated that the webs 40 may be connected to the outer connecting portion 38 at any point between its first and second ends 41, 43.

By providing a rigid connection between the middle tube and one end of the inner tube 10, it can be seen that the thermal expansion connector 32 constrains the inner tube 10 against sliding (axial) movement relative to the middle tube 12. However, since the expansion connector 32 is provided at only one end of inner tube 10, the opposite end of tube 10 is left free to expand along axis A. This is advantageous because, during operation of the heat exchanger, the inner tube 10 is in constant contact with hot, compressed air and is therefore at a considerably higher temperature than the middle tube 12 and outer tube 14, both of which are in direct contact with the coolant. The difference in temperatures causes differential thermal expansion of the inner tube 10 along longitudinal axis A, relative to the middle tube 12 and outer tube 14. Constraining the inner tube 10 at both ends would therefore cause stresses on the heat exchanger 100 during each thermal cycle, increasing the risk that the heat exchanger 100 would fail prematurely.

The heat exchanger 100 may also, include another feature to accommodate thermal expansion of the inner tube 10, and this is now described with reference to FIGS. 6 to 9. It will be appreciated that heat transfer may be enhanced by brazing the top and bottom surfaces of the fin and turbulizer 22, 24 to the surrounding tubes 10, 12, 14. However, these braze joints produce rigid connections between the tubes 10, 12, 14 throughout their lengths, and this may result in increased thermal stresses during use of the heat exchanger 100. In the heat exchangers according to the invention, the top surface of the fin 22 in the inner air passageway 18 is rigidly connected, for example by brazing, to the inner surface of the middle tube 12 (FIG. 7), while the bottom surface of fin 22 is in contact with the outer surface of the inner tube 10 but is not brazed or otherwise rigidly attached to inner tube 10 (FIG. 8). Thus, the inner tube 10 is left free to expand and contract along the axis A.

Also, the turbulizer 24 in the outer coolant passage 20 may have its bottom surface rigidly connected, for example by brazing, to the outer surface of middle tube 12 (FIG. 7), so as to enhance heat transfer from the air to the coolant. Meanwhile, the top surface of turbulizer 24 is in contact with the inner surface of the outer tube 14 but is optionally not brazed or otherwise rigidly attached to outer tube 14 (FIG. 9). This has the effect of minimizing unwanted heat transfer from the hot engine compartment to the coolant circulating in the outer passageway 20, and is not related to minimizing thermal stresses due to differential thermal expansion of tubes 12 and 14, which are already rigidly connected to one another.

Therefore, in heat exchanger 100, the fin and turbulizer 22, 24 are brazed to the middle tube 12, but are not brazed to either the inner tube 10 or the outer tube 14. This selective bonding can be accomplished in different ways. For example, the fin 22 and turbulizer 24 may be pre-bonded to the middle tube 12, and this sub-assembly can then be combined with the inner tube 10 and outer tube 14. Alternatively, the heat exchanger 100 can be assembled and then brazed, in which case the selective bonding to the middle tube can be accomplished by using a tube clad or otherwise provided with brazing alloy which forms a liquid filler metal when heated to brazing temperature, whereas the inner and outer tubes 10, 14 may simply comprise tubes which do not include a cladding of brazing alloy, or which are clad with a brazing alloy on the surface which is not contacted by the fin 22 or turbulizer 24.

Figure 10:
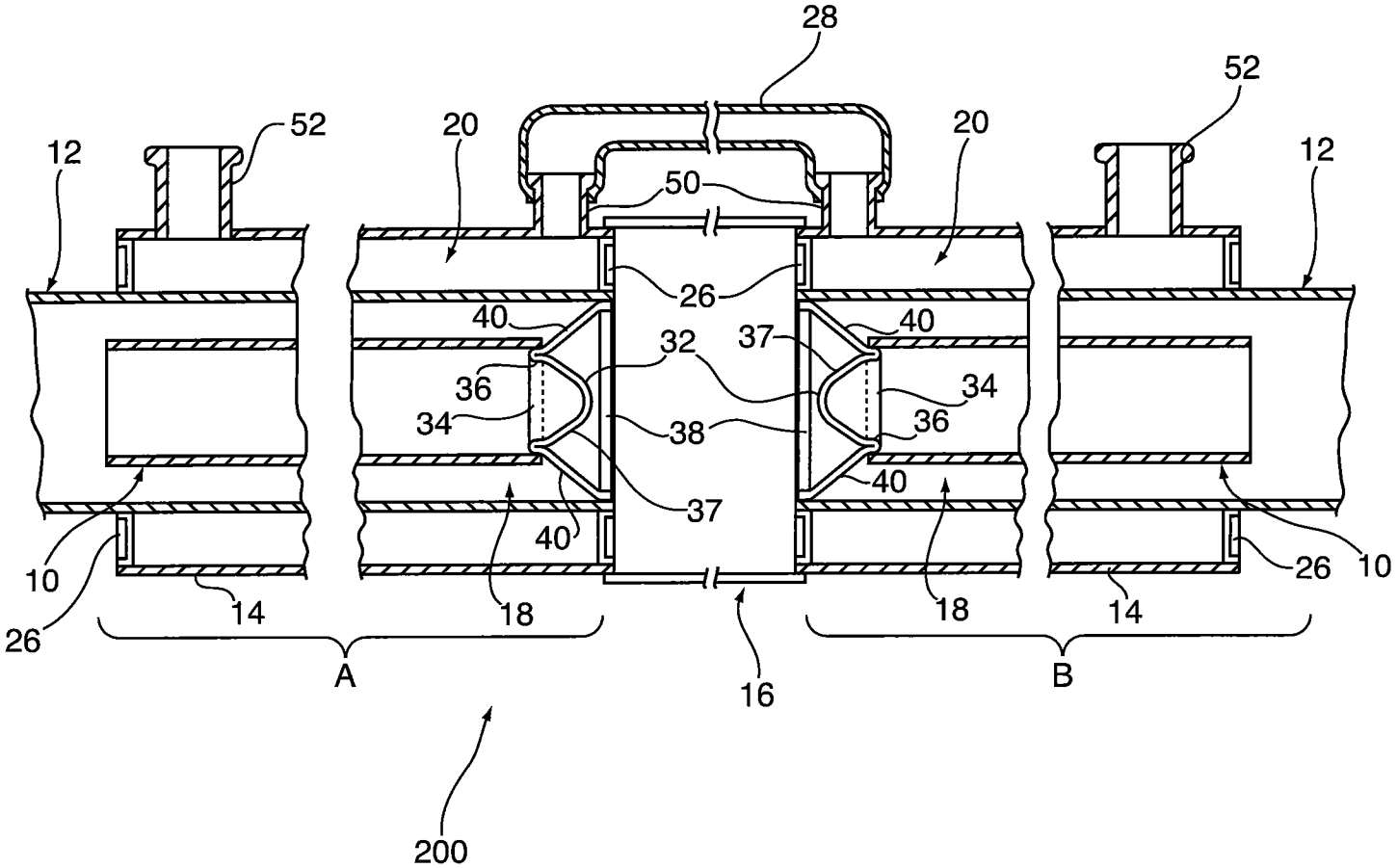
FIG. 10 is a longitudinal cross section of a segmented gas-liquid heat exchanger according to second embodiment of the invention.

FIG. 10 illustrates a heat exchanger 200 according to a second embodiment of the invention. Heat exchanger 200 is segmented and is comprised of two heat exchanger segments A and B connected by an air conduit 16, typically a tube or a hose which includes at least one bend (not shown). Each heat exchanger segment A or B comprises a heat exchanger which is substantially identical to heat exchanger 100, except where otherwise noted below. The segmenting of heat exchanger 200 may be advantageous where it is necessary to incorporate charge air cooling into a conduit located within a confined space in an engine compartment, and which may not have straight sections sufficiently long to accommodate a single heat exchanger 100 of the required heat exchange capacity. The use of a segmented heat exchanger 200 therefore allows a large heat exchange capacity to be incorporated into a compact space. It will be appreciated that segmented heat exchangers according to the invention may be constructed with more than two segments, and that the segments may either be the same as or different from one another. For example, the segments may differ from one another in length, diameter of one or more tubes, or in the appearance of the thermal expansion connector 32. In heat exchanger 200, the thermal expansion connectors 32 of segments A and/or B may have a configuration which differs from thermal expansion connector 32 of heat exchanger 100. For example, as shown in FIG. 10, the central plug portion 34 comprises a relatively shallow inner connecting portion 36 and a convex blocking portion which protrudes out from the end of the inner tube 10.

Each end of air conduit 16 is connected to one of the projecting ends of a middle tube 12 of one of the segments A or B. This creates a continuous flow path for charge air through the inner air passageway 18 of segment A, through the air conduit 16, and through the inner air passageway 18 of segment B. There are numerous ways in which the air conduit 16 can be connected to segments A and B, and the specific type of connection is not important to the present invention. For the purpose of illustration, the ends of tubes 12 are inserted into the ends of air conduit 16, and may either be sealed by clamping or by brazing. The conduit 16 can be formed of metal or from another material such as plastic or rubber.

As mentioned above, the segments A and B may be modified by extending the outer tubes 14 beyond the ends of middle tube 12, in which case the air conduit 16 may be connected to the outer tubes 14.

The outer coolant passageways 20 of the two segments A and B are connected by a coolant conduit 28, typically a tube or a hose. The coolant conduit 28 extends between the outlet fitting 52 of segment A and the inlet fitting 50 of segment B. If desired, a radiator and/or a pump (not shown) may be incorporated into the coolant conduit 28 between segments A and B.

Figure 11:
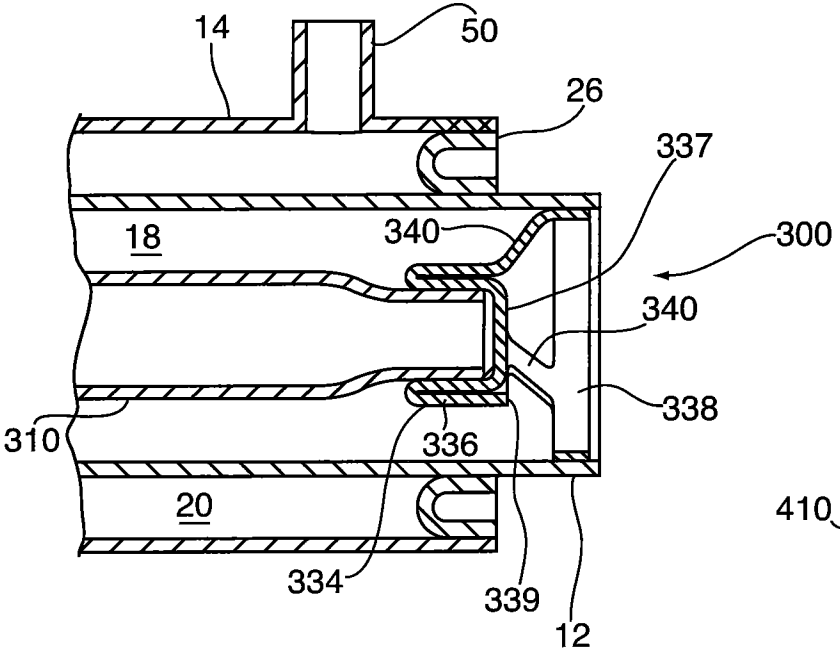
FIG. 11 is a partial cross sectional view of a heat exchanger according to a third embodiment of the invention.

A heat exchanger 300 according to a third embodiment of the invention is now described below with reference to FIG. 11. Heat exchanger 300 is identical to heat exchanger 100 described above, except as noted below, and like elements of heat exchanger 300 are therefore identified by identical reference numerals.

Heat exchanger 300 differs from heat exchanger 100 in that the thermal expansion connector 32 is replaced by a thermal expansion connector 332 having webs 340 identical to webs 40 of connector 32 and having an outer connecting portion 338 identical to connecting portion 38. However, the central plug portion 334 of connector 332 differs from central plug portion 34 described above in that it includes a blocking portion 337 which is located adjacent the lip 339 thereof. This arrangement has the inner connecting portion 336 projecting away from the lip 339 and the blocking portion 337, leaving the inner connecting portion 336 free to slide over or into the end of the inner tube 10. In heat exchanger 300, the inner tube is identified by reference numeral 310 and is received inside the inner connecting portion 336. As shown, the end of inner tube 310 is optionally reduced in diameter.

Figure 12:
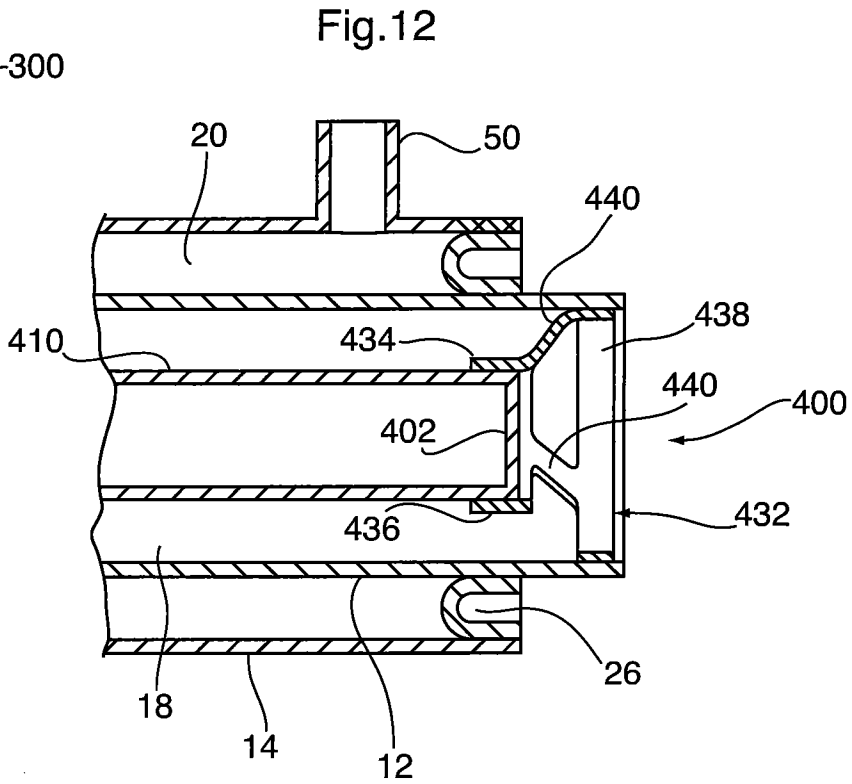
FIG. 12 is a partial cross sectional view of a heat exchanger according to a fourth embodiment of the invention.

A heat exchanger 400 according to a fourth embodiment of the invention is now described below with reference to FIG. 12. Heat exchanger 400 is identical to heat exchanger 100 described above, except as noted below, and like elements of heat exchanger 400 are therefore identified by identical reference numerals.

In heat exchanger 400, the inner tube is identified by reference numeral 410 and is completely closed at one end, having an end wall 402. Therefore, the heat exchanger 400 is provided with a thermal expansion connector 432 which comprises webs 440 which may be similar or identical to webs 40 of connector 32 and an outer connecting portion 438 which may be identical to the continuous or discontinuous outer connecting portions 38 described above. The thermal expansion connector 432 differs from the thermal expansion connectors 32 and 332 primarily in that it does not include a central plug portion having a blocking portion. Rather, the inner connecting portion 436 of thermal expansion connector 432 is in the form of an open-ended cylindrical ring which fits over the end of inner tube 410 similar to the arrangement described above with reference to heat exchanger 300. If desired, the end of inner tube 410 may be reduced in diameter, similar to inner tube 310 described above.

Although the inner connecting portion 436 of thermal expansion connector 432 is shown as comprising a continuous cylindrical ring, it will be appreciated that this is not necessarily the case. Since the function of the inner connecting portion 436 is to connect the webs 440 to the inner tube 410, the inner connecting portion 436 does not need to be in the form of a continuous ring. Rather, the thermal expansion connector 432 may be attached to inner tube 410 by two or more inner connecting portions 436 which are spaced apart from one another. For example, a plurality of inner connecting portions 436 may be provided, each comprising a discrete, longitudinal end portion of a web 440, through which the web 440 is attached to the inner tube 410. Thus, the inner connecting portions 436 could have a configuration analogous to that of the outer connecting portions 38 shown in FIG. 13.

Although the invention has been described in connection with certain embodiments, it is not limited thereto. Rather, the invention includes all embodiments which may fall within the scope of the following claims.

What is claimed is:

1. A concentric tube heat exchanger, comprising:

a) a radially outer tube having a first end and a second end;

b) a radially inner tube concentric with the outer tube, the inner tube having a first end and a second end;

c) a middle tube located between, and concentric with, the inner and outer tubes, wherein the middle tube has a first end and a second end, wherein an annular gas flow passage is formed between the inner tube and the middle tube, wherein an annular coolant flow passage is formed between the middle tube and the outer tube, and wherein the outer, inner and middle tubes extend along a longitudinal axis;

d) a connector comprising:

(i) a radially inner connecting portion rigidly connected to the first end of the inner tube;

(ii) a radially outer connecting portion having a radially inner surface and a radially outer surface, both of which surfaces are parallel to the longitudinal axis, with the outer surface being rigidly connected to a radially inner surface of the middle tube;

(iii) one or more webs extending angularly relative to both a radial direction and the longitudinal axis, and extending between the inner connecting portion and the outer connecting portion, wherein each of the one or more webs has a radially inner end rigidly connected to the inner connecting portion and a radially outer end rigidly connected to the outer connecting portion, and wherein the one or more webs permit gas to flow into the annular gas flow passage; and (iv) a blocking portion which blocks the first end of the inner tube, wherein the inner connecting portion and the blocking portion together form a central plug portion which is rigidly connected to the first end of the inner tube, wherein the inner connecting portion and the blocking portion are integrally formed, wherein the central plug portion is in the shape of a cup with the inner connecting portion forming a cylindrical side wall of the cup and the blocking portion forming a bottom of the cup, wherein the cup has an open top facing outwardly of the first end of the inner tube, and wherein the blocking portion is recessed inwardly along the longitudinal axis from the first end of the inner tube; and e) a turbulence-enhancing insert provided in the gas flow passageway, wherein the insert is in contact with a radially outer surface of the inner tube and a radially inner surface of the middle tube, and wherein the turbulence enhancing insert in the annular gas flow passage is a corrugated fin, and wherein the fin is joined to the inner surface of the middle tube by brazing, and is not brazed or otherwise rigidly attached to the outer surface of the inner tube.

2. The concentric tube heat exchanger of claim 1 wherein, in a plane which is transverse to the longitudinal axis of the tubes, the one or more webs have a combined area which is a minor amount of the total area of the gas flow passage.

3. The concentric tube heat exchanger of claim 1, wherein the connector includes at least two of said webs, and wherein said webs are spaced evenly about the circumference of the inner tube.

4. The concentric tube heat exchanger of claim 1, wherein the cup further comprises a circumferential lip which is distal from the blocking portion and protrudes beyond the end of the inner tube, and wherein the inner ends of the webs are connected to the circumferential lip.

5. The concentric tube heat exchanger according to claim 1, wherein the inner connecting portion of the connector comprises a longitudinally extending cylindrical ring, and wherein the inner ends of the one or more webs are rigidly connected to the inner connecting portion.

6. The concentric tube heat exchanger of claim 5, wherein the inner connecting portion has an outside diameter slightly less than an inside diameter of the first end of the inner tube, wherein the inner connecting portion has a radially outer surface along which it is rigidly connected to a radially inner surface of the first end of the inner tube; or wherein the inner connecting portion has an inside diameter slightly greater than an outside diameter of the first end of the inner tube, wherein the inner connecting portion has a radially inner surface along which it is rigidly connected to a radially outer surface of the first end of the inner tube.

7. The concentric tube heat exchanger of claim 1, wherein the outer connecting portion of the connector comprises a longitudinally extending cylindrical ring, and wherein the outer ends of the one or more webs are rigidly connected to the outer connecting portion.

8. The concentric tube heat exchanger of claim 1, wherein the connector includes a plurality of said webs and a plurality of said outer connecting portions, wherein the outer end of each said web is rigidly connected to one of said outer connecting portions.

9. The concentric tube heat exchanger of claim 1, wherein the connector includes a plurality of said webs and a plurality of said inner connecting portions, wherein the inner end of each said web is rigidly connected to one of said inner connecting portions.

10. The concentric tube heat exchanger of claim 1, wherein each of the ends of the middle tube is adapted for connection to a gas flow conduit, wherein the first end of the inner tube is located inside the middle tube; and wherein the inner tube is shorter than the middle tube, and wherein both the first and second ends of the inner tube are located inside the middle tube.

11. The concentric tube heat exchanger of claim 1, wherein the outer tube is shorter than the middle tube, and wherein the outer tube is sealed at its first and second ends to the outer surface of the middle tube.

12. The concentric tube heat exchanger of claim 1, wherein the outer tube is provided with inlet and outlet openings for a liquid coolant.

13. The concentric tube heat exchanger of claim 1, wherein the annular coolant flow passage is provided with a turbulence enhancing insert which is in contact with the outer surface of the middle tube and the inner surface of the outer tube.

14. The concentric tube heat exchanger of claim 13, wherein the turbulence enhancing insert in the annular coolant flow passage is a turbulizer, and wherein the turbulizer is joined to the outer surface of the middle tube by brazing, and is not brazed to the inner surface of the outer tube.

15. The concentric tube heat exchanger of claim 1, wherein the inner connecting portion of the connector is rigidly connected to the first end of the inner tube by brazing, and the outer surface of the outer connecting portion of the connector is rigidly connected to the inner surface of the middle tube by brazing.

16. A hot gas cooling system comprising:

(A) a first concentric tube heat exchanger comprising:

a) a first radially outer tube having a first end and a second end;

b) a first radially inner tube concentric with the first outer tube, the first inner tube having a first end and a second end;

c) a first middle tube located between, and concentric with, the first inner tube and the first outer tube, wherein the first middle tube has a first end and a second end, wherein a first annular gas flow passage is formed between the first inner tube and the first middle tube, wherein a first annular coolant flow passage is formed between the first middle tube and the first outer tube, and wherein the first outer tube, the first inner tube and the first middle tube extend along a longitudinal axis;

d) a first connector comprising:

(i) a radially inner connecting portion rigidly connected to the first end of the first inner tube;

(ii) a radially outer connecting portion having a radially inner surface and a radially outer surface, both of which surfaces are parallel to the longitudinal axis, with the outer surface being rigidly connected to a radially inner surface of the first middle tube;

(iii) one or more webs extending angularly relative to both a radial direction and the longitudinal axis, and extending between the inner connecting portion and the outer connecting portion, wherein each of the one or more webs has a radially inner end rigidly connected to the inner connecting portion and a radially outer end rigidly connected to the outer connecting portion, and wherein the one or more webs permit gas to flow into the first annular gas flow passage; and (iv) a blocking portion which blocks the first end of the first inner tube, wherein the inner connecting portion and the blocking portion together form a central plug portion which is rigidly connected to the first end of the first inner tube, wherein the inner connecting portion and the blocking portion are integrally formed, wherein the central plug portion is in the shape of a cup with the inner connecting portion forming a cylindrical side wall of the cup and the blocking portion forming a bottom of the cup, wherein the cup has an open top facing outwardly of the first end of the first inner tube, and wherein the blocking portion is recessed inwardly along the longitudinal axis from the first end of the first inner tube; and e) a first turbulence-enhancing insert provided in the first gas flow passageway, wherein the first turbulence-enhancing insert is in contact with a radially outer surface of the first inner tube and a radially inner surface of the first middle tube, and wherein the first turbulence-enhancing insert in the first annular gas flow passage is a corrugated fin, and wherein the fin is joined to the inner surface of the first middle tube by brazing, and is not brazed or otherwise rigidly attached to the outer surface of the first inner tube;

(B) a second concentric tube heat exchanger comprising:

a) a second radially outer tube having a first end and a second end;

b) a second radially inner tube concentric with the second outer tube, the second inner tube having a first end and a second end;

c) a second middle tube located between, and concentric with, the second inner tube and the second outer tube, wherein the second middle tube has a first end and a second end, wherein a second annular gas flow passage is formed between the second inner tube and the second middle tube, wherein a second annular coolant flow passage is formed between the second middle tube and the second outer tube, and wherein the second outer tube, the second inner tube and the second middle tube extend along the longitudinal axis;

d) a second connector comprising:

(i) a radially inner connecting portion rigidly connected to the first end of the second inner tube;

(ii) a radially outer connecting portion having a radially inner surface and a radially outer surface, both of which surfaces are parallel to the longitudinal axis, with the outer surface being rigidly connected to a radially inner surface of the second middle tube;

(iii) one or more webs extending angularly relative to both a radial direction and the longitudinal axis, and extending between the inner connecting portion and the outer connecting portion, wherein each of the one or more webs has a radially inner end rigidly connected to the inner connecting portion and a radially outer end rigidly connected to the outer connecting portion, and wherein the one or more webs permit gas to flow into the second annular gas flow passage; and (iv) a blocking portion which blocks the first end of the second inner tube, wherein the inner connecting portion and the blocking portion together form a central plug portion which is rigidly connected to the first end of the second inner tube, wherein the inner connecting portion and the blocking portion are integrally formed, wherein the central plug portion is in the shape of a cup with the inner connecting portion forming a cylindrical side wall of the cup and the blocking portion forming a bottom of the cup, wherein the cup has an open top facing outwardly of the first end of the second inner tube, and wherein the blocking portion is recessed inwardly along the longitudinal axis from the first end of the second inner tube; and e) a second turbulence-enhancing insert provided in the second gas flow passageway, wherein the second turbulence-enhancing insert is in contact with a radially outer surface of the second inner tube and a radially inner surface of the second middle tube, and wherein the second turbulence-enhancing insert in the second annular gas flow passage is a corrugated fin, and wherein the fin is joined to the inner surface of the second middle tube by brazing, and is not brazed or otherwise rigidly attached to the outer surface of the second inner tube;

wherein the first middle tube of the first concentric tube heat exchanger is connected to the second middle tube of the second concentric tube heat exchanger so as to provide flow communication between the first annular gas flow passage of the first concentric tube heat exchanger and the second annular gas flow passage of the second concentric tube heat exchanger.

17. The hot gas cooling system of claim 16, wherein an outlet of the first annular coolant flow passage of the first concentric tube heat exchanger is in flow communication with the inlet of the second annular coolant flow passage of the second concentric tube heat exchanger through a coolant conduit.

18. The hot gas cooling system of claim 17, wherein a heat exchanger for removing heat from said coolant is located in said coolant conduit between the first and second concentric tube heat exchangers.

* * * * *